US005219204A

United States Patent [19]

Bathrick et al.

[11] Patent Number: 5,219,204

[45] Date of Patent: Jun. 15, 1993

[54] RECLINER AND ELEVATOR CHAIR

[76] Inventors: Leeland M. Bathrick, 6820 New Hampshire Trail, Crystal Lake, Ill. 60014; Glenn Brittain, 2613 Drucker La., McHenry, Ill. 60060

[21] Appl. No.: 597,524

[22] Filed: Oct. 15, 1990

[51] Int. Cl.[5] ..... A47C 1/035; A47C 15/00

[52] U.S. Cl. ..... 297/321; 297/84; 297/343; 297/DIG. 10

[58] Field of Search ..... 297/317, 321, DIG. 10, 297/14, 68, 83-85, 345, 330, 342, 343, 320

[56] References Cited

U.S. PATENT DOCUMENTS

| | | | |
|---|---|---|---|
| 2,442,303 | 5/1948 | Mayfield | 297/DIG. 10 X |
| 2,843,402 | 5/1958 | Lautier et al. | 297/320 |
| 3,343,871 | 9/1967 | Yates et al. | 297/DIG. 10 X |
| 3,638,995 | 2/1972 | Flanagan et al. | 297/317 X |
| 4,007,960 | 2/1977 | Gaffney | 297/DIG. 10 X |
| 4,616,874 | 10/1986 | Pietsch et al. | 297/343 X |

FOREIGN PATENT DOCUMENTS

| | | | |
|---|---|---|---|
| 2908897 | 9/1979 | Fed. Rep. of Germany | 297/321 |
| 1124109 | 10/1956 | France | 297/320 |
| 8203320 | 10/1982 | World Int. Prop. O. | 297/DIG. 10 |

*Primary Examiner*—Peter R. Brown

*Attorney, Agent, or Firm*—Dillis V. Allen

[57] ABSTRACT

A recliner chair assembly with a vertical lift that raises the seat back that in turn tilts the seat. The lower end of the back is tracked to cause the back to recline and also to shift the seat horizontally and vertically. Horizontal movement of the seat causes movement relative to the chair arms and ottoman extension and retraction.

16 Claims, 4 Drawing Sheets

RECLINER AND ELEVATOR CHAIR

RELATED APPLICATION

This application is related to a co-pending application filed in the names of Leeland M. Bathrick and Glenn Brittain, U.S. Ser. No. 598,842, Filed Oct. 15, 1990, assigned to the assignee of this application issued as U.S. Pat. No. 5,094,508 on Mar. 10, 1992.

BACKGROUND OF THE INVENTION

Reclining chair mechanisms have become increasingly popular over the last several decades in the residential marketplace because of their comfort and their ability to relieve minor orthopedic maladies. These reclining mechanisms fall into two or three general categories. In one conventional design the seat and chair back have no relative movement and tilt as a unit to effect the recline position. In others, the seat and back tilt but the back has a significantly greater angular movement than the seat so that significant back recline is possible without projecting the forward end of the seat upwardly to a point where the user's knees block vision of the surrounding area.

Both of these general designs have been provided in the past with extendable ottomans or leg rests. Usually, a lazy tong or scissors-type linkage is provided for supporting, extending and retracting this leg support, and this linkage is actuated in many cases by a control link pivotally mounted to the frame that has relative horizontal movement with respect to a seat frame with part of the ottoman linkage connected to the seat frame and another part connected to this control link that with appropriate geometry can extend and retract the ottoman.

In all of these reclining chair mechanisms, at least the ones that we are familiar with, the linkage mechanisms for operating the articulating functions of the chair back and the seat frame and the ottoman are located underneath the seat frame. In this location it is quite difficult to conceal the operating mechanism because some degree of flexibility must be provided. In some cases the arm assemblies are extended to cover the area under the seat which, of course, presents an obvious cosmetic problem. However, arm articulation is also common in these reclining chair mechanisms and if the arm moves up and down, it exposes the area under the seat presenting a further problem of concealment.

It should be understood that the concealment problem is not only one of aesthetics but one of safety. Exposed linkages under the chair are readily accessible to the operator's hands and also to children that may be crawling around the area of the chair. These linkage systems operate through lever principles so that very high forces can be generated by these linkage systems easily capable of breaking fingers and also larger human bones.

Elevator chair mechanisms that assist user entry and exit from a seat portion of the chair, while initially successful in the nursing home and clinic marketplaces, have only recently achieved some degree of success in the residential marketplace. Formerly believed desirable only for patients with severe lower extremity immobility, today such chair elevator or lift systems have found acceptance by users with significantly lesser handicaps including those with simply inflammatory arthritis in the lower extremity joints and other orthopedic maladies commonly found in people over 50 years of age.

In the residential marketplace, of course, the chair mechanism must be aesthetically acceptable and complementary to the home environment which necessitates the motor drive assembly be compact and located where it may be easily covered by upholstery. It also requires the lift linkages or arms be similarly located to be easily concealed by fabric. More importantly, the linkage or actuator assembly for the chair should have a low power requirement in order to reduce the size of the drive motor necessary, and decreased power consumption to provide a lift chair at a lower cost than formerly available.

There have been a plurality of attempts at designing such chair mechanisms and one is shown in the Gaffney, U.S. Pat. No. 3,250,569 which shows a conventional homestyle lounge chair where the seat moves upwardly and tilts forwardly to facilitate user exit. The design is compact and has a few number of links and for that reason it is for the most part acceptable in the residential market. However, in this chair only the seat elevates and the back remains in a stationary position with the arms, so the user has some apprehension in entering and exiting the chair because in the entry and exit position the user cannot contact the back at all and the arms are in a very depressed position relative to the seat.

There are, however, seat mechanisms designed in the past where the arms and back move upwardly and forwardly and one is illustrated in the Gaffney, U.S. Pat. No. 4,083,599. In this design the seat, back and arms are one unitary assembly all stationary with respect to one another and the chair is raised and lowered by a pair of generally parallel arms generally horizontally disposed, fixed at the rear to a stationary frame plate and at the front to a lift frame for the chair. The actuator is a screw drive and also acts as a third extending link connected at the rear to the same frame and at its front end to the forward center portion of the chair frame. This parallelogram type linkage has high power requirements and thus necessitates an excessively large motor for the residential marketplace. Also, the location of the various links underneath the chair frame require a substantial amount of additional upholstery to cover the linkage mechanism and provide a safe actuation system.

The Gorden, U.S. Pat. No. 2,608,239 shows a threaded screw actuator that raises and lowers a chair back bar with side members slidable in generally vertical grooves in vertical rails. The Gorden chair lifts as a unit and has no seat tilting.

The Ragsdale, et al., U.S. Pat. No. 2,895,539 shows a reclining exercise chair where a control link for the reclining back has a follower at its lower end that rides on a curved track that controls the pivotal movement of the back.

The Yates, et al., U.S. Pat. No. 3,343,871 shows an automatically operated invalid chair that has a reclining back and a seat frame that moves with a slotted follower mechanism to lift and seat tilt positions. There is no upward movement of the front portion of the seat upon lift.

The Re, U.S. Pat. No. 3,359,034 shows a reclining chair with a multiple scissor-type ottoman extension supported between a seat frame and a control link that pivotally carries the seat frame by spaced short lengths, but the control link moves back and forth relative to the seat frame to effect ottoman extension and retraction and at the same time seat back tilting.

Another Re patent, U.S. Pat. No. 3,758,151 shows a recliner mechanism somewhat similar to the above Re patent except that the back does not appear to articulate separately from the seat.

The Crum, et al., U.S. Pat. No. 3,858,932 shows a mechanism somewhat similar to Re's where the arms are moveable relative to the seat and a control link is utilized to operate the ottoman. But as with Re's U.S. Pat. No. 3,758,151, there does not appear to be back articulation relative to seat.

The Gaffney, U.S. Pat. No. 4,007,960 discloses a mechanism for back to seat articulation, ottoman extension and chair lift. As in the above Gaffney patent, the actuator assembly and linkage is disposed entirely underneath the seat demanding very high power requirements and this chair has problems with exposed linkages and upholstery around the linkage mechanism under the seat. Furthermore, as in the above Gaffney elevator chair, the seat back tilts forwardly upon lift which is not really desirable.

The Randolph, U.S. Pat. No. 4,077,483 shows a track-type invalid vehicle where the seat is moveable to a raised position with a generally vertical threaded screw. The screw lifts the entire chair, and there is no seat to back articulation or seat tilting.

The Andreasson, U.S. Pat. No. 4,249,774 shows a chair lift mechanism, but in this device while the seat articulates, it does so in two pieces and there is no articulation between the seat portion and the back portion.

The Booth, U.S. Pat. No. 4,545,616 shows a lift mechanism for a mobile chair with elevating seat where the seat is raised by a vertical screw that lifts the seat back. It does show articulation between the chair back and the seat frame with a generally parallelogram type linkage. Because of this four bar linkage, the back of the chair moves relatively toward the front of the seat as the chair is lifted. This is permitted by wheels that support a front link of the chair in one embodiment and the seat back in another embodiment, both designed for horizontal translating movement.

The Yoshikawa, et al., U.S. Pat. No. 4,572,573 shows a curved guide that supports the back for reclining movement guided by stationary rollers.

The Crum, U.S. Pat. No. 4,662,673 shows an away-from-the-wall recliner chair with no lift where the back articulates relative to the seat and the arms also move relative to the seat all with a rather complicated linkage system.

The Krauska, U.S. Pat. No. 4,852,939 shows a device for converting or retrofitting a recliner chair to a recliner lift chair with a mechanism somewhat similar to the mechanism shown in the Gaffney, U.S. Pat. No. 4,007,960 described above, except that it does appear that Krauska's arms articulate relative to the seat. Krauska does not include any chair back to seat articulation and note that the seat frame is pivotally mounted by spaced short links on a control rail that scissors with the seat frame to effect ottoman scissor linkage movement.

It is a primary object of the present invention to provide an improved reclining mechanism both with and without elevation that ameliorates the problems noted above in prior art reclining systems.

SUMMARY OF THE PRESENT INVENTION

In accordance with the present invention, an improved recliner chair assembly is provided with a space-conserving vertical lift mechanism that raises and lowers the top of the chair back. Movement of the lower part of the back is controlled by a curved track and follower that moves the lower part of the back horizontally to achieve back recline. The back in turn shifts the seat frame horizontally and vertically to effect ottoman linkage operation, seat tilting, arm to seat relative movement, and seat elevation.

By locating this lift mechanism vertically at the rear of the chair frame, complex linkages normally located under the seat frame are completely eliminated.

The forward end of the seat carries short links that articulate the seat front on generally horizontal control links. The forward ends of the control links are in turn articulated on the chair frame by further short links that are generally horizontally and forwardly disposed when the chair is in its recline position. This geometry causes the forward end of the seat to lift somewhat upon elevation to keep the user's post knee area stable during elevation without lifting the user's feet off the floor.

Since the chair back carries the seat and provides the power for moving the seat, back to seat articulation or angle change during recline is effected without the need for complex linkages between the back and the seat normally thought necessary in prior art designs.

A further feature of the present invention is that the chair arms are carried by the control links described above so that as the chair moves from its fully reclined position to an upright sitting position, the arms move forwardly relative to the seat, and this is desirable because the user's upper torso and arms also move forwardly as the back moves from its recline position to its generally vertical position.

This function is achieved without additional linkage because the control links also function as the operator for the ottoman scissors linkage. The relative horizontal movement between the seat frame and these control links is utilized to operate the ottoman linkage as the chair moves from its fully recline position to its upright sitting position with the seat frame generally horizontal and the seat back generally vertical.

The seat back is reciprocated upwardly and downwardly by a linear threaded actuator that engages a seat back frame telescopic mechanism. By driving the seat back directly in pure linear reciprocating motion, the power requirements for the motor drive are significantly reduced and the linkage normally required underneath the seat in prior designs is virtually non-existent. This is because the actuator is positioned substantially in a single plane coincident with the seat back, although extending to the floor. The only linkage required is single link at each of the forward sides of the seat frame that articulate the seat to the chair frame, and these links are generally horizontal in the down position so they occupy virtually no vertical space beneath the seat.

As the actuator drives the chair back linearly upwardly, the seat is effectively pulled upwardly by the chair back at the rear of the seat, and the seat pivots relative to the back, tilting forwardly to facilitate exit.

One of the principal advantages of the present chair mechanism is that it achieves chair lift with chair back articulation with respect to seat so that the back does not push the user out of the seat during lift. Another important aspect is that the forward end of the seat lifts to be certain the user's legs behind the knees are fully supported during entry and exit to give the user a more secure transition.

Other objects and advantages of the present invention will appear more clearly from the following detailed description.

DETAILED DESCRIPTION OF THE PREFERRED EMBODIMENT

Figure 1:
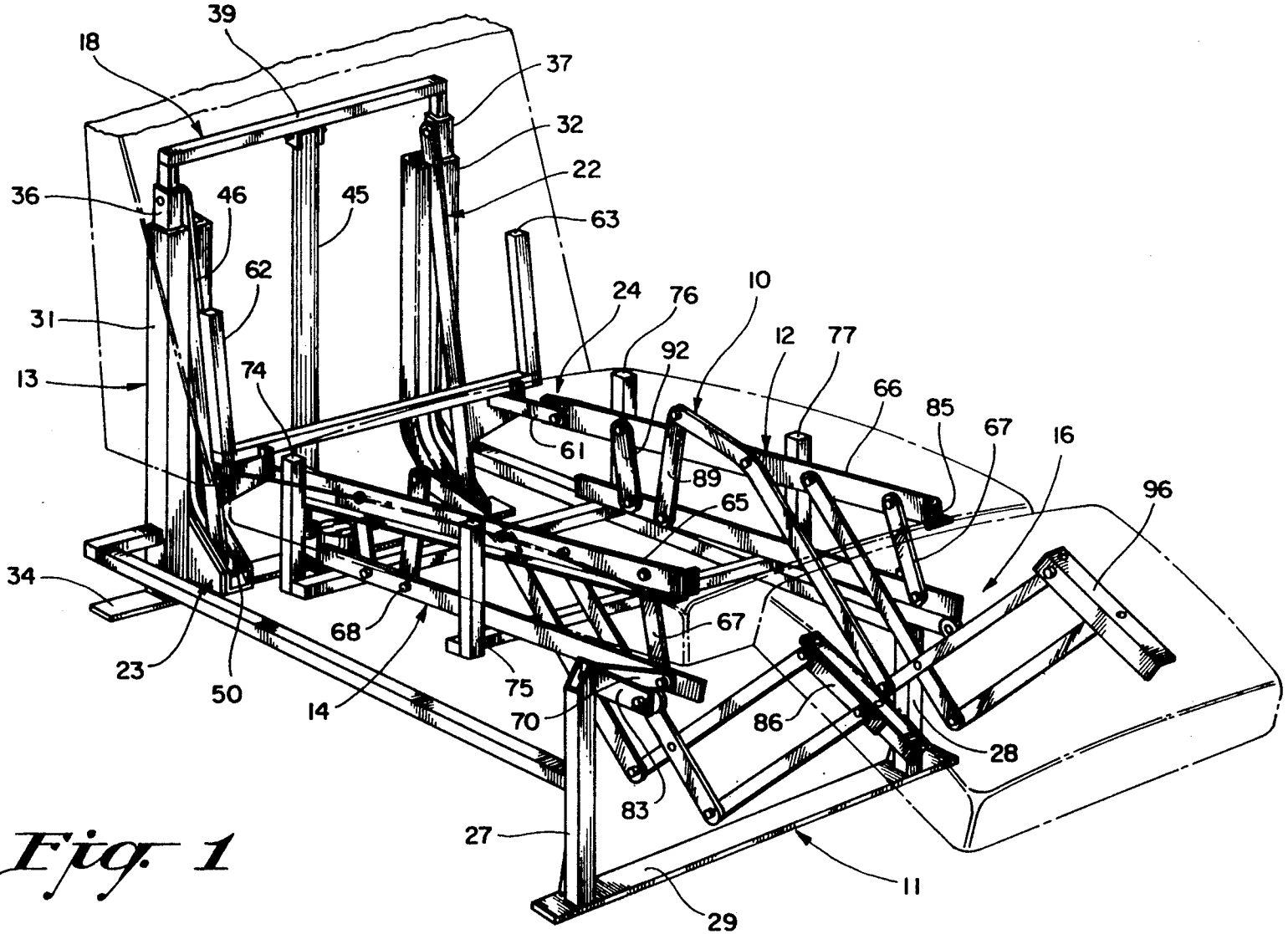
FIG. 1 is a perspective view of the present chair assembly in its fully reclined position absent its wooden frame and the upholstery, although the upholstery is illustrated in dotted lines in some of the other figures.
Figure 2:
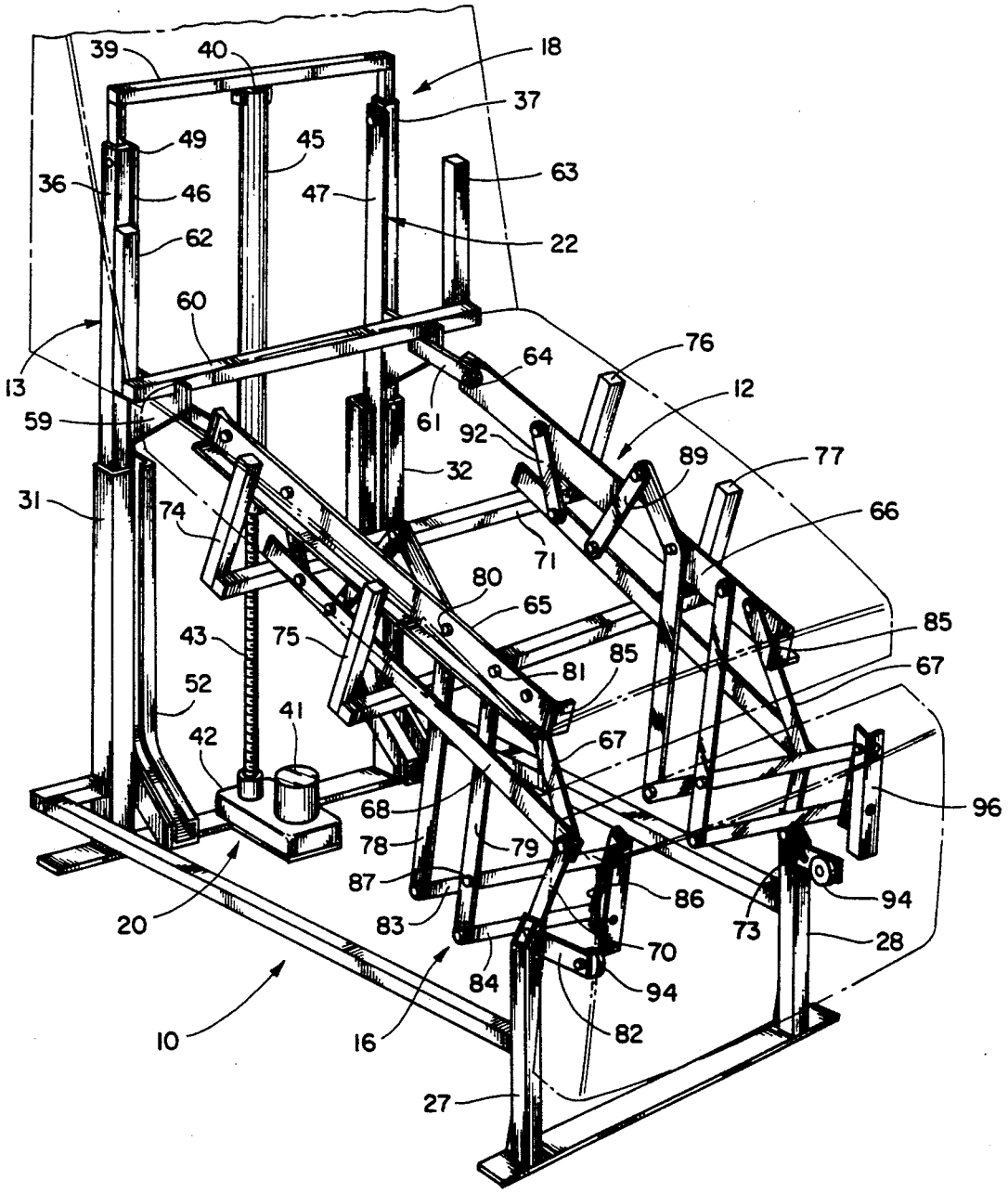
FIG. 2 is a perspective view of the chair assembly illustrated in FIG. 1 in its elevated or lift position.
Figure 3:
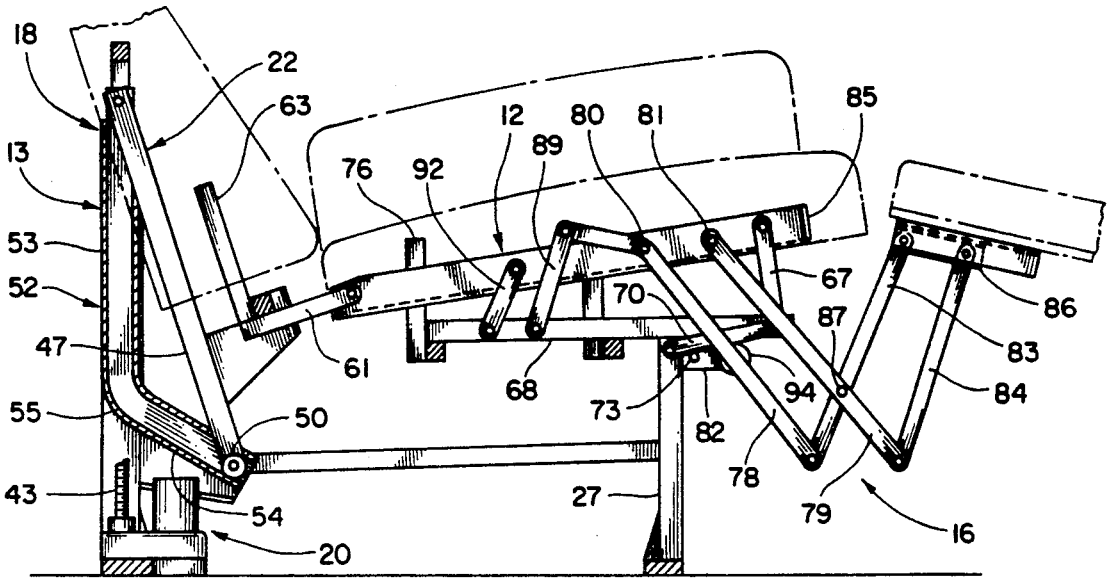
FIG. 3 is a side view of the chair assembly illustrated in FIGS. 1 and 2 in its recline position shown in FIG. 1.

Referring to the drawings and particularly FIGS. 1 to 3, a chair assembly 10 is illustrated generally consisting of a stationary chair frame 11, a seat frame 12 having a control linkage 14 supported therefrom that operates with seat frame 12 an ottoman linkage 16, a telescoping lift assembly 18 operated by a motor driven screw drive 20, and a chair back frame assembly 22 pivotally mounted at its top on the lift assembly 18 with its angular position controlled by a track and follower assembly 23, and the back frame pivotally carries the rear end of the seat frame 12 at pivot assembly 24.

The chair frame 11 includes forward square tubular legs 27 and 28 connected by a floor engaging cross member 29, and rear square tubular members 31 and 32 interconnected by floor engaging cross member 34.

Tubular members 31 and 32 also form part of the lift assembly 18 that has tubular slides 36 and 37 slidably received in tubular members 31 and 32 respectively.

The slides 36 and 37 are interconnected by cross member 39.

The motor driven screw drive 20 includes motor 41, reduction gearing 42 that reversely rotates a generally vertically oriented screw 43 under the control of a user operated switch (not shown). Screw 43 threadedly engages a nut in tube 45 that engages cross member 39 centrally and is connected thereto by connector 40. Reverse rotation of screw 43 thereby raises and lowers the lift assembly 18 from its lowermost position illustrated in FIGS. 1 and 3 to its fully elevated position illustrated in FIGS. 2 and 5. It should be understood that suitable limit switches are provided to limit movement of the lift assembly 18 between these two positions.

The chair back assembly 22 includes a pair of spaced parallel long links 46 and 47 pivotally connected at their upper ends 49 to the lift assembly slides 36 and 37. The lower ends of the links 46 and 47 carry follower rollers 50 that form part of the track assembly 23, that ride in curved enclosed tracks 52 fixedly mounted to the insides of the tubular members 31 and 32.

As seen more clearly in FIG. 3, for example, tracks 52 have a generally vertical portion 53, a downwardly and forwardly projecting straight portion 54 that angles downwardly and forwardly at an angle of approximately 30 degrees to horizontal, and a curved interconnecting transition portion 55.

The back frame 22 also includes a pair of forwardly directed flanges 59 interconnected by a cross member 60 that fixedly carries spaced tubular members 62 and 63 that support the seat back cushion shown in dotted lines.

Flanges 59 have forwardly extending links 61 pivotally connected at 64 to spaced parallel angle members 65 and 66 that form the seat frame 12.

The forward end of the seat frame members 65 and 66 are articulated by short links 67 on the forward ends of control links 68 that are part of the control linkage assembly 14.

The control links 68 are suspended from the seat frame 12 by rear links 92 and front links 67. The forward ends of the control links 68 and the forward seat links 67 are pivotally supported and articulated on the tops of frame members 27 and 28 by further short links 70. Note that the short links 70 extend generally horizontally and forwardly in the fully reclined position of the chair assembly illustrated in FIGS. 1 and 3. In this position the links engage stops 73 fixed to horizontal frame portions 82 fixed to tubular members 27 and 28. Stops 73 prevent clockwise rotation of links 70 and thereby limit the downward movement of the forward part of seat frame 12.

The control links 68 carry cross members 71 and 72 that form part of an arm frame assembly that includes upwardly extending tubular arm frames 74, 75, 76 and 77. In this way the arms move with the control links 68.

The seat frame members 65 and 66 also pivotally support ottoman links 78 and 79 at pivots 80 and 81.

Links 78 and 79 have further ottoman links 83 and 84 pivotally connected at their ends that carry ottoman frame brackets 86 at their distal ends. Ottoman links 79 and 83 are pivotally connected together at 87 to obtain the correct ottoman geometry. The ottoman position is controlled relative to the seat frame 12 by links 89 pivotally connected to control links 68 at their lower ends and pivotally connected at their upper ends to upward extensions of ottoman links 78.

Figure 4:
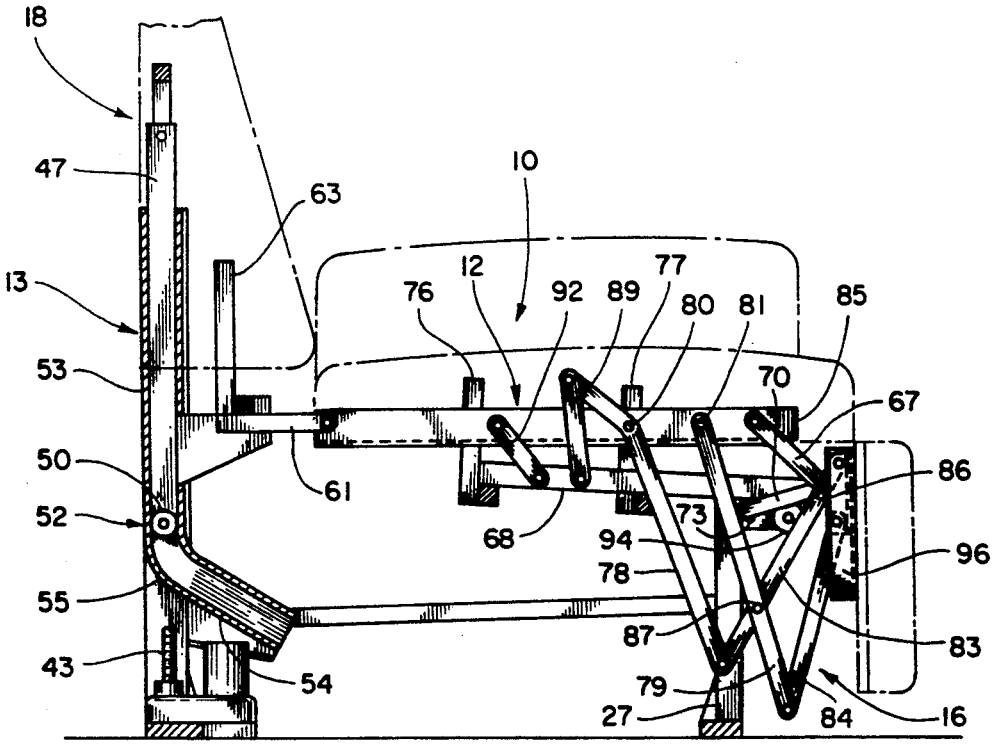
FIGS. 4 and 5 are side views similar to FIG. 3, with the chair assembly in its sitting and fully elevated positions, respectively.
Figure 5:
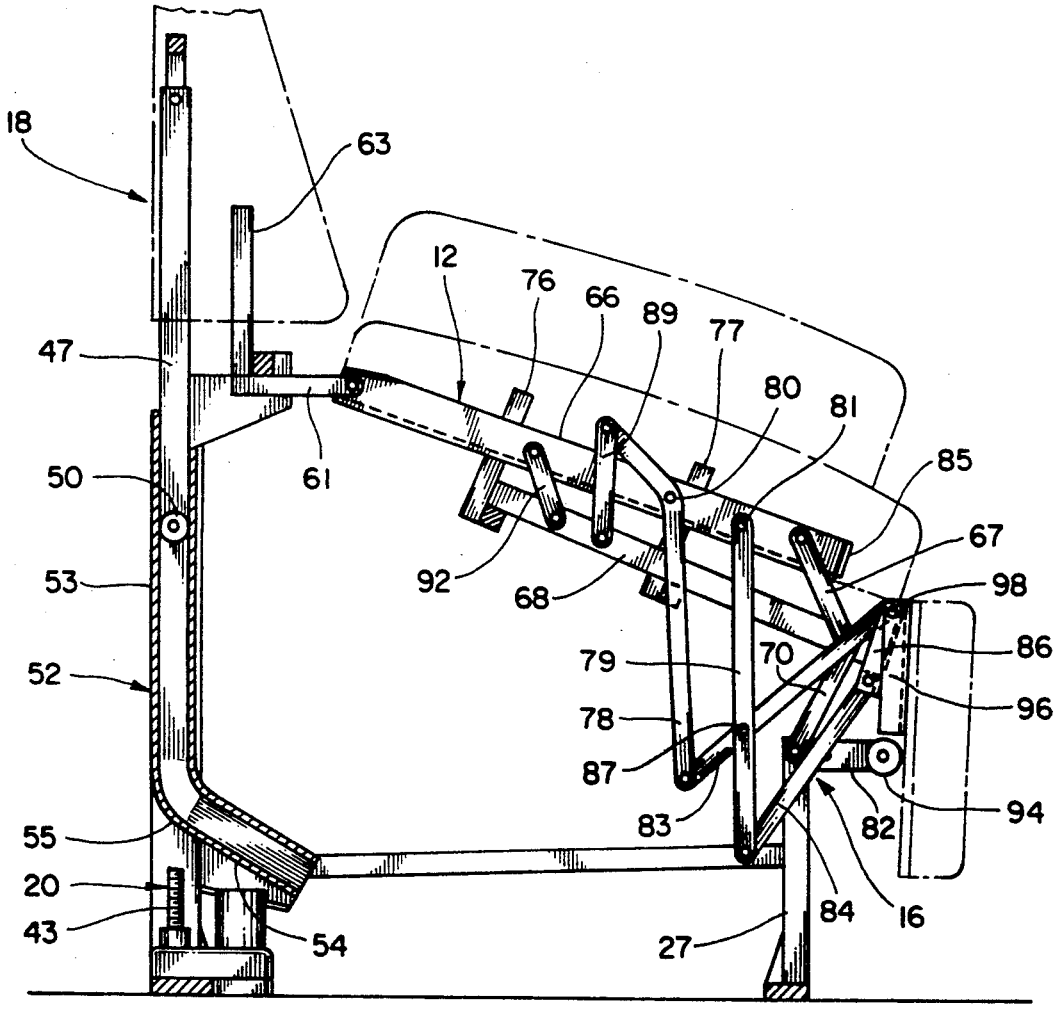

The operation of the present chair can be seen more easily by viewing the sequence of operation illustrated in FIGS. 3, 4 and 5.

In the fully reclined position illustrated in FIG. 3, the back frame 22 is tilted rearwardly so that the back is in its fully reclined position, and in that position followers 50 are at the forward ends of the lower straight portions 54 of tracks 52. The chair back to seat frame pivots 64 position the rear end of the seat frame lower than its forward end. Note that control links 68 are generally horizontal and the control link to seat frame forward short links 67 are generally vertical, the control link to chair frame forward links 70 project generally horizontally forwardly engaging stops 73, and rear control link to chair frame short links 92 are also generally vertical and somewhat forwardly projecting. This geometry pushes ottoman drive links 89 to their most clockwise positions fully extending the ottoman linkage 16 and its brackets 86. This is the rearmost positions of control links 68 relative to the seat frame 12 and thus the arm frame members 74, etc. are also in their rearmost positions relative to the seat frame 12.

It should be noted here that it is the relative horizontal motion between the seat frame 12 and the control links 68 that effects not only ottoman extension and retraction but also the relative position of the arms to the seat frame 12 and the position of the forward end of the seat frame 12.

When the screw drive assembly 20 is actuated to raise the lift assembly 18 from the fully reclined position illustrated in FIG. 3, the slide members 36 and 37 move upwardly, links 46 and 47 are drawn upwardly, and tracks 52 constrain rollers 50 to move upwardly and rearwardly through the curve portions 55 of the tracks into straight portion 53 to the position illustrated in FIG. 4. This action rotates links 46 and 47 clockwise to positions parallel to the tubular members 31 and 32. At the same time back frame members 62 and 63 move to almost vertical positions.

The seat frame 12 is generally horizontal in its FIG. 4 sitting position because the rear of the seat frame has moved upwardly by the upward movement of the back frame assembly 22 and the forward end of the seat frame has moved somewhat downwardly because forward control short links 70 stay engaged with stops 73 in the same positions as in the fully reclined position of FIG. 3 while forward chair frame short links 67 rotate counterclockwise from their generally vertical positions in FIG. 3 thereby lowering the forward end of the seat frame 22 as it shifts rearwardly. Forward seat frame links 67 engage flanges 85 on the forward ends of frame members 65 and 66 limiting further counter clockwise roation of links 67 relative to the seat frame 12 and downward movement of the forward portion of the seat frame.

It is this rearward movement of the seat frame 12 relative to the control links 68 that causes retraction of the ottoman linkage 16 driven rearwardly by ottoman drive links 89.

Furthermore, this rearward movement of the seat frame 12 relative to the control links 68 appears to move the arm frame members 74, 75, 76 and 77 forwardly with respect to the seat frame 12 although in fact they remain relatively stationary with respect to the chair frame.

In FIG. 5, the chair is shown in its fully elevated or lift position achieved by the maximum upward extension by screw drive 20. During upward movement from the FIG. 4 position, rollers 50 ride in straight track portions 53, which as noted are generally vertical. Similarly, the back frame members 62 and 63 remain almost vertical and move linearly upwardly raising the rear of the seat frame similarly linearly upwardly. Relative movement between the seat frame 12 and the control link 68 is very small during this FIG. 4 to FIG. 5 movement and thus the ottoman linkage 16 remains passive as does the position of the arms of the chair with respect to seat frame 12.

Somewhat short of the fully elevated position illustrated in FIG. 5, ottoman 92 engages frame rollers 94 limiting movement of the ottoman in a vertical position. Further lifting causes ottoman brackets 86 to pivot somewhat away from ottoman frames 96 to which they are pivoted at 98. Forward links 70 are pulled and rotate upwardly away from stops 73. Seat forward links 67 remain engaged with flanges 85 stabilizing the forward part of the seat frame 12. The forward end of the seat frame moves upwardly and somewhat rearwardly as the control link forward short links 70 pivot upwardly to accommodate movement of the rear of the seat frame by arms 61.

We claim:

1. An articulated recliner-elevator chair assembly, comprising: a chair frame, a lift assembly generally vertically mounted at the rear of the chair frame, an articulated back frame pivotally connected to the lift assembly at one end thereof, guide means for controlling motion of the other end of the back frame as the lift assembly moves generally vertically upwardly and downwardly so the back frame moves to an inclined position as the lift assembly moves downwardly and moves to a generally vertical position as the lift assembly moves upwardly, a seat frame, first means movably connecting the seat frame at its forward end to the chair frame and second means pivotally connecting the seat frame at its rear end to the back frame so movement of the back frame raises and lowers and the rear end of the seat frame, and a generally vertical actuator at the rear of the chair frame engageable with the lift assembly for raising and lowering the lift assembly from a lower position where the back frame is inclined and the seat frame is generally horizontal to a lift position where the back frame is generally vertical and the seat frame is inclined forwardly and downwardly to assist in entry and exit from the chair assembly.

2. An articulated recliner-elevator chair assembly as defined in claim 1, wherein the guide means includes an arcuate track fixed with respect to the chair frame, said back frame including a back frame linkage pivotally connected at its upper end to the lift assembly and having a follower at its other end engageable in the arcuate track, said track being shaped so that as the lift assembly is lowered the back frame tilts backwardly into a recline position.

3. An articulated recliner-elevator chair assembly as defined in claim 1, including a generally horizontal control link mounted below and generally parallel to the seat frame, said control link being movably connected at its forward end to the chair frame, link means pivotally connected to the rear end of the control link and to an intermediate portion of the seat frame, arm rests carried by the control link, and means movably connecting the control link to the chair frame so the seat frame moves rearwardly relative to the control link and arm rests as the lift frame moves initially from its lower position toward its lift position and thereafter the control link and the arm rests remain substantially stationary relative to the seat frame as the lift assembly moves further toward the lift position.

4. An articulated recliner-elevator chair assembly as defined in claim 1, including a generally horizontal control link mounted below and generally parallel to the seat frame, said control link being movably connected at its forward end to the chair frame, link means connecting the rear end of the control link to an intermediate portion of the seat frame, and an ottoman linkage carried by the seat frame and control link operated by relative movement between the seat frame and control link.

5. An articulated recliner-elevator chair as defined in claim 1, wherein the lift assembly includes a pair of stationary generally vertical tubes slidably receiving a pair of slide members connected by a cross frame member, said actuator including a screw drive assembly engageable with the cross frame member.

6. An articulated recliner-elevator chair assembly, comprising: a chair frame, a lift assembly generally vertically mounted at the rear of the chair frame, an articulated back frame pivotally connected to the lift assembly at one end thereof, guide means for controlling motion of the other end of the back frame as the lift assembly moves generally vertically upwardly and downwardly so the back frame moves to an incline position as the lift assembly moves downwardly and moves to a generally vertical position as the lift assembly moves upwardly, a seat frame, first means movably connecting the seat frame at its forward end to the chair frame and second means pivotally connecting the seat frame at its rear end to the back frame so movement of the back frame raises and lowers the rear end of the seat frame, a generally vertical actuator at the rear of the chair frame engageable with the lift assembly for raising and lowering the lift assembly from a lower position where the back frame is inclined and the seat frame is generally horizontal to a lift position where the back frame is generally vertical and the seat frame is inclined forwardly downwardly to assist in entry and exit from the chair assembly, the guide means including an arcuate track fixed with respect to the chair frame, said back frame including a back frame linkage pivotally connected at its upper end to the lift assembly and having a follower at its other end engageable in the arcuate track, said track being shaped so that as the lift assembly is lowered the back frame tilts backwardly into a recline position, the lift assembly including a pair of stationary generally vertical tubes slidably receiving a pair of slide members connected by a cross frame member, said actuator including a screw drive assembly engageable with the cross frame member.

7. An articulated recliner-elevator chair assembly, comprising: a chair frame, a lift assembly generally vertically mounted at the rear of the chair frame, a back frame movably by the lift assembly and pivotally connected at its upper end to the lift assembly, guide means for the lower end of the back frame constructed to rearwardly incline the back frame as the lift assembly moves to a lower position and to vertically position the back frame as the lift assembly moves to an upper position, said guide means being constructed to move the lower end of the back frame a substantial distance vertically upwardly as the lift assembly moves the upper end of the back frame vertically upwardly, a seat frame, means movably mounting the seat frame on the chair frame, means connecting the seat frame to the back frame so the lift assembly moves the back frame and also moves the seat frame through the back frame, and an actuator for the lift assembly carried by the chair frame.

8. An articulated recliner chair assembly as defined in claim 7, wherein the guide means includes an arcuate track fixed with respect to the chair frame, said back frame including a back frame linkage pivotally connected at its upper end to the lift assembly and having a follower at its other end engageable in the arcuate track, said track being shaped so that as the lift assembly is lowered the back frame tilts backwardly into a recline position.

9. An articulated recliner chair assembly as defined in claim 7, wherein the lift assembly includes a pair of stationary generally vertical tubes slidably receiving a pair of slide members connected by a cross frame member, said actuator including a screw drive assembly engageable with the cross frame member.

10. An articulated recliner-elevator chair assembly, comprising: a chair frame, a lift assembly generally vertically mounted at the rear of the chair frame, a back frame movable by the lift assembly and pivotally connected at its upper end to the lift assembly, guide means for the lower end of the back frame constructed to rearwardly incline the back frame as the lift assembly moves to a lower position and to vertically position the back frame as the lift assembly moves to an upper position, a seat frame, means movably mounting the seat frame on the chair frame, means connecting the seat frame to the back frame so the lift assembly moves the back frame and also moves the seat frame through the back frame, an actuator for the lift assembly carried by the chair frame, a generally horizontal control link mounted below and generally parallel to the seat frame, said control link being movably connected at its forward end to the chair frame, and link means connecting the rear end of the control link to an intermediate portion of the seat frame, arm rests carried by the control link, and means movably connecting the control link to the chair frame so the seat frame moves rearwardly relative to the control link and arm rests as the lift frame moves initially from its lower position toward its upper position and thereafter the control link and the arm rests remain substantially stationary relative to the seat frame as the lift assembly moves further upwardly.

11. An articulated recliner-elevator chair assembly, comprising: a chair frame, a lift assembly generally vertically mounted at the rear of the chair frame, a back frame movable by the lift assembly and pivotally connected at its upper end to the lift assembly, guide means for the lower end of the back frame constructed to rearwardly incline the back frame as the lift assembly moves to a lower position and to vertically position the back frame as the lift assembly moves to an upper position, a seat frame, means movably mounting the seat frame on the chair frame, means connecting the seat frame to the back frame so the lift assembly moves the back frame and also moves the seat frame through the back frame, and an actuator for the lift assembly carried by the chair frame, a generally horizontal control link mounted below and generally parallel to the seat frame, said control link being movably connected at its forward end to the chair frame, link means connecting the rear end of the control link to an intermediate portion of the seat frame, and an ottoman linkage carried by the seat frame and control link movable by relative movement between the seat frame and control link.

12. A recliner chair assembly, comprising: a chair frame, a control link mounted on the chair frame for generally horizontal movement, link means movably connecting the forward end of the control link for swinging movement to the forward end of the chair frame to accommodate the generally horizontal movement of the control link, a seat frame connected to the control link by a swinging link for generally horizontal movement in a direction opposite the control link, arm rests connected to the control link, said control link being supported on the seat frame at one end thereof by the swinging link, means movably interconnecting the other end of the control link on the seat frame, a reclining back having a back frame connected to articulate relative to the seat and move from a reclined position to a generally vertical position, said back being movable relative to the control link and the arm rests, and actuator means for moving the seat frame relative to the control link and the back frame so that as the back moves from its reclined position toward its generally vertical position the seat frame moves rearwardly relative to the control link and arm rests.

13. A recliner chair assembly as defined in claim 12, wherein said link means includes a link substantially shorter than the control link connecting the forward end of the control link to the chair frame, said shorter link being generally horizontal and forwardly extending in the reclined position of the back frame.

14. A recliner chair assembly as defined in claim 13, including an ottoman linkage carried by the seat frame and control link operated by relative movement between the seat frame and control link.

15. A recliner chair assembly, comprising: a chair frame, a control link mounted on the chair frame for generally horizontal movement, link means movably connecting the forward end of the control link for swinging movement to the forward end of the chair frame to accommodate the generally horizontal movement of the control link, a seat frame connected to one end of the control link by a swinging link for generally horizontal movement in a direction opposite the control link, means movably mounting the other end of the control link on the seat frame, arm rests connected to the control link, a reclining back having a back frame connected to articulate relative to the seat and move from a reclined position to a generally vertical position, and actuator means for moving the seat frame relative to the control link and the back frame so that as the back moves from its reclined position toward its generally vertical position the seat frame moves rearwardly relative to the control link and arm rests, a lift assembly at the rear of the chair frame mounted for generally vertical movement, said actuator means including a screw drive assembly mounted generally vertically at the rear of the chair frame engageable with the lift assembly for moving it from a lower position to a lift position, said back frame being pivotally connected at its upper end to the lift assembly, guide means for controlling movement of the lower end of the back frame as the lift assembly moves generally upwardly and downwardly so the back frame moves to an inclined position as the lift assembly moves downwardly and moves to a generally vertical position as the lift assembly moves upwardly, said seat frame being pivotally connected at its rear end to the back frame so the back frame raises and lowers the rear end of the seat frame.

16. A recliner chair assembly as defined in claim 15, wherein the guide means includes an arcuate track fixed with respect to the chair frame, said back frame including a back frame linkage pivotally connected at its upper end to the lift assembly and having a follower at its other end engageable in the arcuate track, said track being shaped so that as the lift assembly is lowered the back frame tilts backwardly into a recline position.

* * * * *